US007264540B1

(12) United States Patent
Brantley

(10) Patent No.: US 7,264,540 B1
(45) Date of Patent: Sep. 4, 2007

(54) ARROW BLADE SHARPENING APPARATUS

(76) Inventor: Gary D. Brantley, 13123 Country Rd. 108, Lampasas, TX (US) 76550

( * ) Notice: Subject to any disclaimer, the term of this patent is extended or adjusted under 35 U.S.C. 154(b) by 0 days.

(21) Appl. No.: 11/672,118

(22) Filed: Feb. 7, 2007

(51) Int. Cl.
*B24B 7/00* (2006.01)

(52) U.S. Cl. ..... 451/194; 451/234; 451/451

(58) Field of Classification Search ..... 451/190–194, 451/196, 198, 234, 260, 261, 278, 262, 241, 451/451, 457
See application file for complete search history.

(56) References Cited

U.S. PATENT DOCUMENTS 2,865,141 A * 12/1958 Madl et al. ..... 451/194
3,258,878 A * 7/1966 Clark ..... 451/194
3,733,933 A 5/1973 Longbrake
5,157,879 A 10/1992 Fletcher
6,071,181 A * 6/2000 Wightman et al. ..... 451/192
6,142,038 A 11/2000 Kenesky
6,932,683 B2 * 8/2005 Li ..... 451/193

* cited by examiner

*Primary Examiner*—Dung V Nguyen
(74) *Attorney, Agent, or Firm*—Crossley Patent Law; Mark Ashley Crossley

(57) ABSTRACT

The arrow blade sharpening apparatus is best suited for precision sharpening of arrow blades, Exacto® knife blades, and other like edges which require precision and fine honing. The transparent lidded apparatus is motorized and counter rotates drive gears and then ceramic abrasive wheels with a single motor. The slot of the housing and the guide of the blade holder provide for exact sharpening work without the possibility of angle misalignment of the blade-to-wheel contact.

20 Claims, 4 Drawing Sheets

ARROW BLADE SHARPENING APPARATUS

BACKGROUND OF THE INVENTION

An arrow blade, especially a broadhead used for hunting, must be razor sharp in order to be effective in establishing a clean kill. Even a one-time use of a blade dulls the blade, whether in a target, an object, or in game. Typically, the only recourse for a hunter is to replace blades. An alternative is blade sharpening. Blade sharpening is difficult, as the blades must literally be razor sharp. To accomplish this, the blades must be sharpened at an exactly precise and controlled angle, with an appropriate sharpening device. Sharpening an arrow blade correctly calls for removal of individual blades. Unfortunately, sharpening devices which do not provide the needed precision are inadequate. Additionally, sharpening devices not made of the proper materials result in uneven sharpening as well. Imprecise devices also cause undue blade wear and microscopic ragged metal edges. Additionally, any motorized device should be correctly shielded such than no metallic particles are ejected, particles which might injure a user.

The present apparatus provides a safe means for precision sharpening of arrow blades and other related objects in need of sharpening.

1. Field of the Invention

The arrow blade sharpening apparatus relates to sharpening tools and more specifically to an arrow blade sharpening apparatus which provides for safely in precisely sharpening a replaceable arrow blade or other similar object.

2. Description of the Prior Art

Prior related art U.S. Pat. No. 3,733,933 issued to Longbrake 1973 May 22 teaches a sharpener for arrowheads. The sharpener is manual. The sharpener cannot provide the precision of the current apparatus. U.S. Pat. No. 5,157,879 issued to Fletcher 1992 Oct. 27 teaches a broadhead arrow sharpener. The sharpener does not provide the precision nor the sharpening capability of a removed blade of the current apparatus. U.S. Pat. No. 6,142,038 issued to Kenesky et al. 2000 Nov. 07 teaches a knife and broadhead blade sharpener. The sharpener cannot provide the precision of the current apparatus.

While the above-described devices fulfill their respective and particular objects and requirements, they do not describe an arrow blade sharpening apparatus that provides for the advantages of the present arrow blade sharpening apparatus. In this respect, the present arrow blade sharpening apparatus substantially departs from the conventional concepts and designs of the prior art. Therefore, a need exists for an improved arrow blade sharpening apparatus.

SUMMARY OF THE INVENTION

The general purpose of the arrow blade sharpening apparatus, described subsequently in greater detail, is to provide an arrow blade sharpening apparatus which has many novel features that result in an improved arrow blade sharpening apparatus which is not anticipated, rendered obvious, suggested, or even implied by prior art, either alone or in combination thereof.

To attain this, the arrow blade sharpening apparatus is comprised of a parallelepiped housing with a hinged removable cover. The rounded top cover provides for best visibility of sharpening within when closed. The cover is provided with sufficient flexibility such that the female hinges can be spread to disengage from the male hinges of the housing, thereby providing for selective cover removal when needed.

The counter rotating abrasive wheels are made of ceramic, which thereby affords sharpening the arrow blades to the needed fine edge without undue blade abrasion or microscopic metal irregularities typical of rougher, less precise stones.

The rectangular slot in the housing slideably receives the like-shaped guide of the blade holder. The blade is thereby precisely held in movable contact with abrasive wheels as needed, without chance of misalignment. The flexible tongues of the blade clamp of the holder provide for a user to position the blade within the holder as needed. The counter rotating drive gears are in direct contact with each other, thereby providing for drive of the sharpening with a single motor.

More than one power option is provided by varied embodiments of the apparatus. Standard electrical outlet power is used for one embodiment. Another embodiment provides battery power for the motor.

Thus has been broadly outlined the more important features of the improved arrow blade sharpening apparatus so that the detailed description thereof that follows may be better understood and in order that the present contribution to the art may be better appreciated.

An object of the arrow blade sharpening apparatus is to provide exactly precise blade sharpening.

Another object of the arrow blade sharpening apparatus is to provide precision via a track and matching blade holder.

A further object of the arrow blade sharpening apparatus is to provide proper abrasion for sharpening An added object of the arrow blade sharpening apparatus is to provide for sharpening a removable blade.

And, an object of the arrow blade sharpening apparatus is to be motor driven.

Additionally, an object of the arrow blade sharpening apparatus is to be safe.

These together with additional objects, features and advantages of the improved arrow blade sharpening apparatus will be readily apparent to those of ordinary skill in the art upon reading the following detailed description of presently preferred, but nonetheless illustrative, embodiments of the improved arrow blade sharpening apparatus when taken in conjunction with the accompanying drawings.

In this respect, before explaining the current embodiments of the improved arrow blade sharpening apparatus in detail, it is to be understood that the arrow blade sharpening apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved arrow blade sharpening apparatus. It is therefore important that the claims be regarded as including such equivalent constructions insofar as they do not depart from the spirit and scope of the arrow blade sharpening apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 5 thereof, the principles and concepts of the arrow blade sharpening apparatus generally designated by the reference number 10 will be described.

Figure 1:
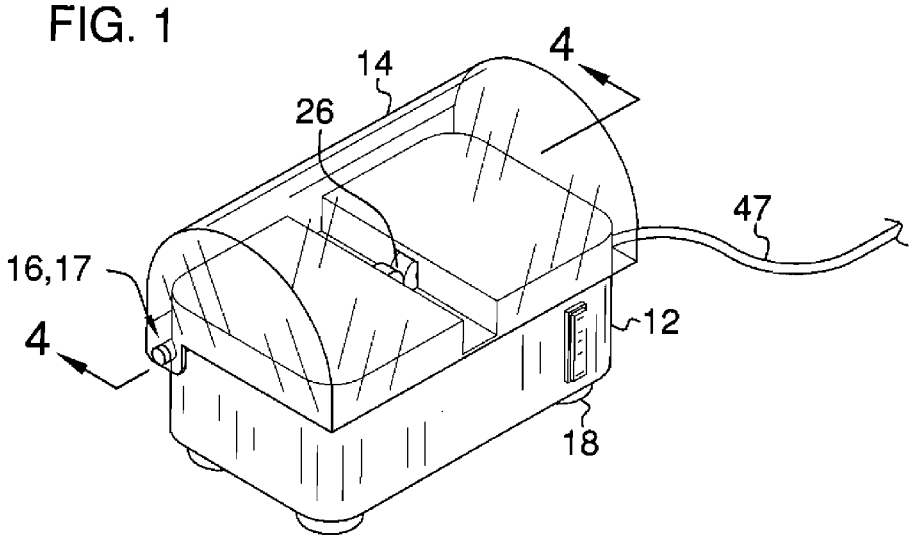
FIG. 1 is a perspective view of the housing, lid closed.
Figure 2:
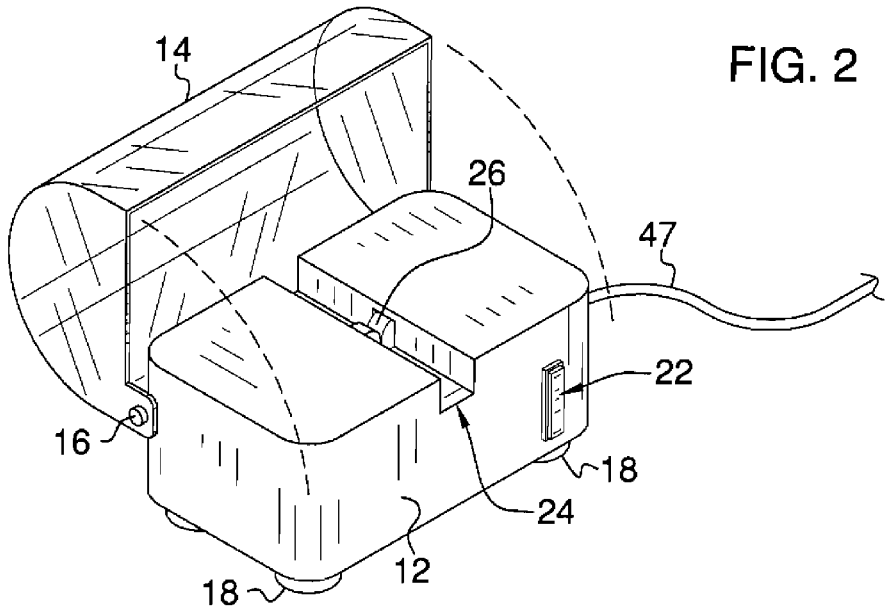
FIG. 2 is a perspective view of the housing, lid open.

Referring to FIGS. 1 and 2, the motorized arrow blade sharpening apparatus 10 partially comprises a parallelepiped housing 12. The housing 12 has a front, a back, two sides, a top, and a bottom. The transparent lid 14 is hingedly fitted atop the housing 12. The hinged fit of the lid 14 to the housing 12 comprises a female hinge 17 on the lid 14. The male hinge 16 is disposed on the housing 12. The preferred embodiment of the lid 14 provides a lid 14 which is sufficiently flexible to allow removal of the lid 14 from the housing 12 by flexing the lid 14 to disengage the female hinge 17 from the male hinge 16. The lid 14 is rounded for best viewing of the sharpening process. The lid 14 is transparent. The housing 12 is comprised of a rectangular slot 24 within the housing 12 top. The pair of opposed abrasive wheels 26 is disposed within the housing 12. The wheels 26 are partially exposed within the slot 24. The switch 22 is disposed on the front of the housing 12. The switch 22 provides for activation and use of the apparatus 10 while the lid 14 is closed, thereby shielding a user from metal and abrasive wheel 26 debris which might otherwise be ejected.

Figure 3:
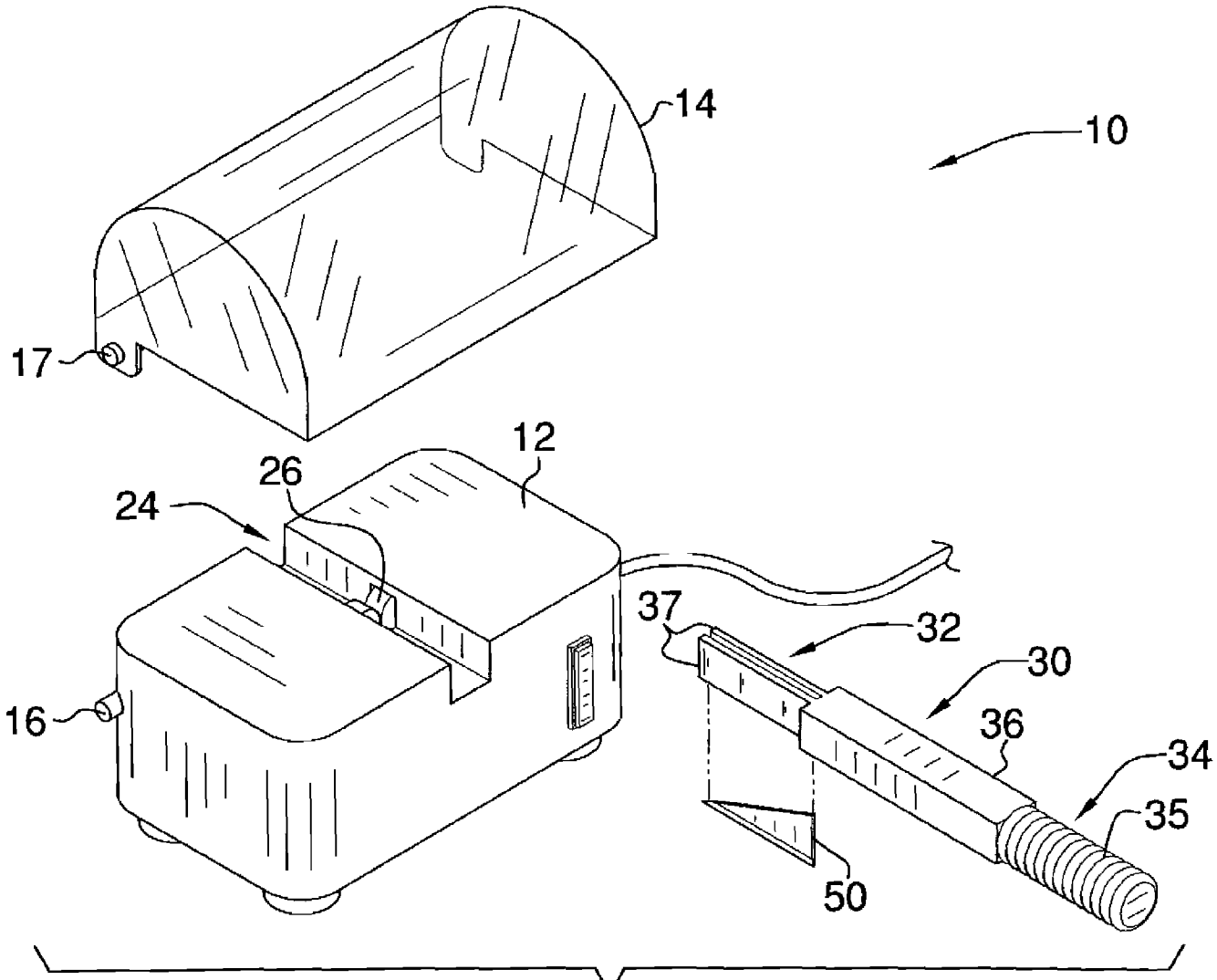
FIG. 3 is perspective view of the housing with lid removed, and including the blade holder.

With reference to FIG. 3, the entire apparatus 10 also comprises the blade holder 30. The blade holder 30 removably holds a blade 50. The blade holder 30 has a first end, a second end, and a length therebetween. The blade holder 30 further comprises a rectangular guide 36 as a part of the length. The guide 36 slideably fits within the housing slot 24. The fit of the guide 24 is a close tolerance fit within the slot 24, thereby insuring precise blade engagement with the wheels 26. The blade holder 30 further comprises a handle 34 on the first end. The preferred embodiment of the handle 34 provides the non-slip grip 35. The blade clamp 32 is disposed on the second end of the blade holder 30. The blade clamp 32 is comprised of a flexible material with memory. The blade clamp 32 comprises two spaced apart tongues 37 with a gap therebetween. The tongues 37 are comprised of a flexible material with memory such that spreading the tongues 37 apart allows for inserting a blade 50. Releasing spread-apart tension on tongues 37 provides that the blade 50 is securely held as needed.

Figure 4:
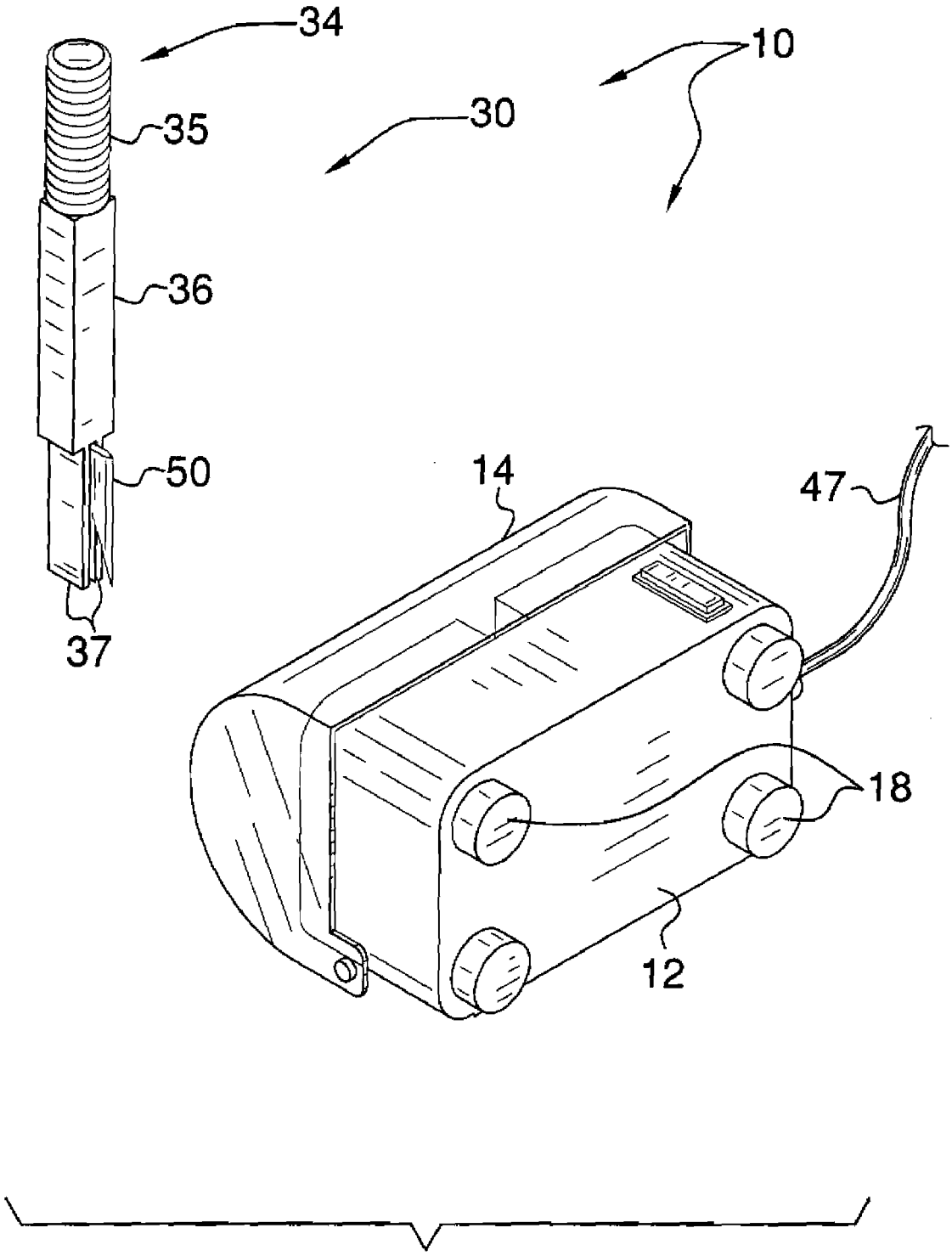
FIG. 4 is perspective view of the entire apparatus.

Referring to FIG. 4, the bottom of the housing 12 is comprised of a plurality of spaced apart non-slip feet 18. The feet 18 provide for the housing 12 to remain stable upon a surface during the sharpening process without the need for a user to hold the housing 12.

Figure 5:
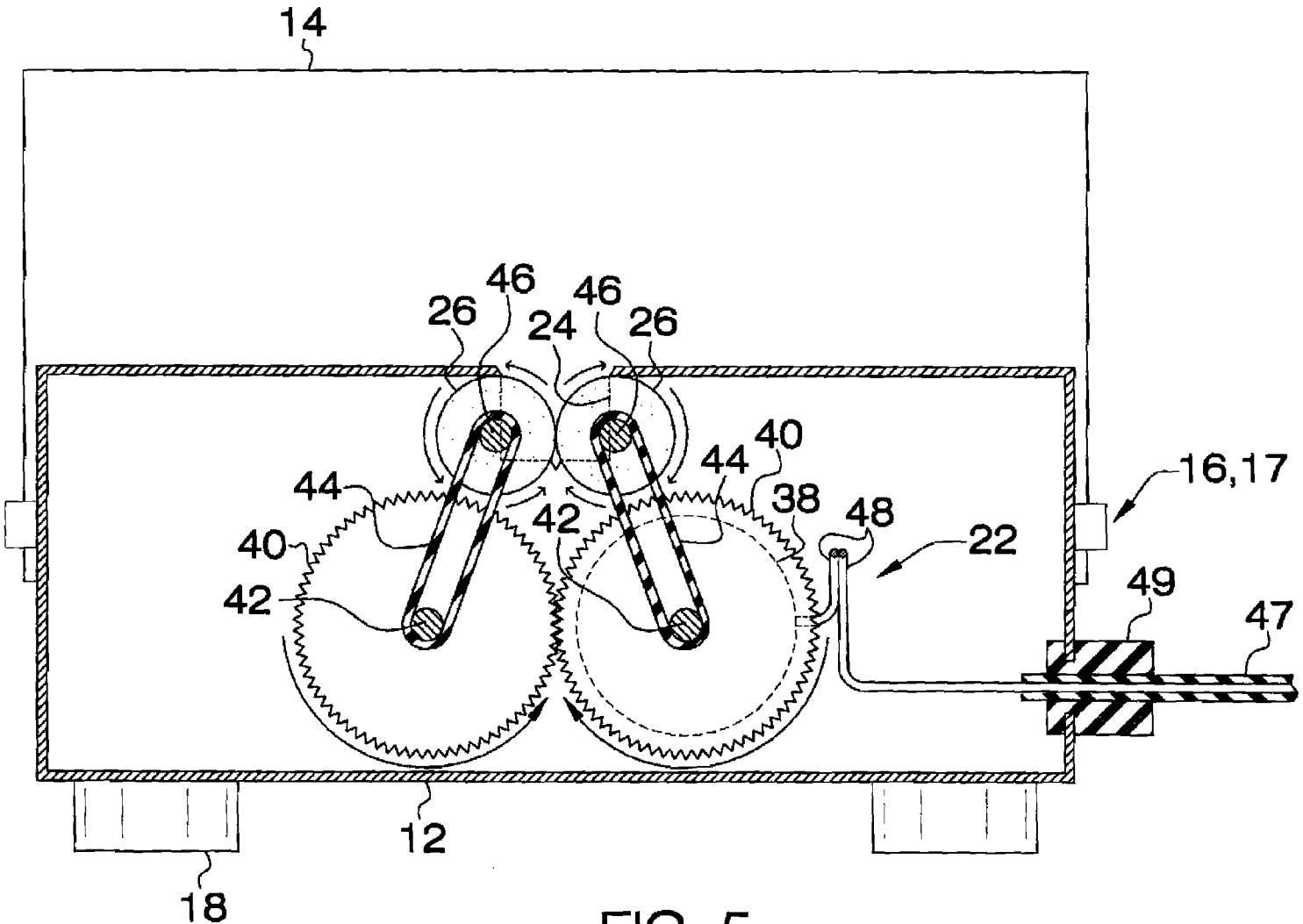
FIG. 5 is a cross sectional view of the housing with lid, and internal components of the apparatus.

In referring to FIG. 5, the internal components of the apparatus 10 further comprise the abrasive wheels 26, each of which is affixed to a rotatable wheel axle 46. The pair of opposed connected counter rotating drive gears 40 are proximal to the abrasive wheels 26. A drive axle 42 is affixed to each drive gear 40. A drive belt 44 connects each of one of the drive axles 42 to one of the wheel axles 46, respectively. By providing belt 44 driven abrasive wheels 26, the apparatus 10 provides a weak link for belt 44 slippage, should a blade 50 or some other object be jammed between the wheels 26. This weak link thereby adds a safety margin for apparatus 10 components and for a user. The motor 38 is disposed within the housing 12. The motor 38 drives one of the drive gears 40. The motor 38 driven drive gear 40 drives the other drive gear 40. The drive gears 40 are thereby counter rotated with respect to each other. The power cord 47 plugs into a standard electrical outlet after departing the housing 12 via the grommet 49. Another embodiment of the apparatus 10 is battery powered (not shown). Electrical wires 48 connect the power, switch 22, and motor 38. The switch 22 is disposed on the exterior front of the housing 12. The switch 22 controls the power source to the motor 38. The switch 22 placement provides for the apparatus 10 to be operated with the lid 14 closed.

With respect to the above description then, it is to be realized that the optimum dimensional relationships for the parts of the arrow blade sharpening apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the arrow blade sharpening apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the arrow blade sharpening apparatus may be used.

Therefore, the foregoing is considered as illustrative only of the principles of the arrow blade sharpening apparatus. Further, since numerous modifications and changes will readily occur to those skilled in the art, it is not desired to limit the arrow blade sharpening apparatus to the exact construction and operation shown and described, and accordingly, all suitable modifications and equivalents may be resorted to, falling within the scope of the arrow blade sharpening apparatus.

What is claimed is:

1. A motorized arrow blade sharpening apparatus, comprising, in combination:

a parallelepiped housing having a front, a back, two sides, a top, and a bottom;

a transparent lid hingedly fitted atop the housing;

a rectangular slot within the housing top;

a pair of opposed abrasive wheels within the housing, the wheels partially exposed within the slot;

an rotatable axle affixed to each wheel;

a pair of opposed connected counter rotating drive gears within the housing;

a drive axle affixed to each drive gear;

a drive belt connecting each of one of the drive axles to one of the wheel axles, respectively;

a motor within the housing, the motor driving one of the drive gears;

a power source for the motor;

a switch on an exterior of the housing, the switch controlling the power source to the motor;

a blade holder for removably holding the blade, the blade holder having a first end, a second end, and a length therebetween, the blade holder comprising:

a rectangular guide comprising part of the length, the guide slideably fitting within the housing slot;

a handle on the first end of the blade holder;

a blade clamp on the second end of the blade holder.

2. The apparatus according to claim 1 wherein the hinged fit of the lid to the housing further comprises a female hinge on the lid;

a male hinge on the housing.

3. The apparatus according to claim 1 further comprising a flexible lid, the flexibility sufficient to allow removal of the lid from the housing.

4. The apparatus according to claim 2 further comprising a flexible lid, the flexibility sufficient to allow removal of the lid from the housing.

5. The apparatus according to claim 1 wherein the bottom of the housing is further comprised of a plurality of non-slip feet.

6. The apparatus according to claim 2 wherein the bottom of the housing is further comprised of a plurality of non-slip feet.

7. The apparatus according to claim 3 wherein the bottom of the housing is further comprised of a plurality of non-slip feet.

8. The apparatus according to claim 4 wherein the bottom of the housing is further comprised of a plurality of non-slip feet.

9. The apparatus according to claim 5 wherein the blade holder handle further comprises a non-slip grip.

10. The apparatus according to claim 6 wherein the blade holder handle further comprises a non-slip grip.

11. The apparatus according to claim 7 wherein the blade holder handle further comprises a non-slip grip.

12. The apparatus according to claim 8 wherein the blade holder handle further comprises a non-slip grip.

13. A motorized arrow blade sharpening apparatus, comprising, in combination:

a parallelepiped housing having a front, a back, two sides, a top, and a bottom;

a transparent lid hingedly fitted atop the housing;

a rectangular slot within the housing top;

a pair of opposed abrasive wheels within the housing, the wheels partially exposed within the slot;

an rotatable axle affixed to each wheel;

a pair of opposed connected counter rotating drive gears within the housing;

a drive axle affixed to each drive gear;

a drive belt connecting each of one of the drive axles to one of the wheel axles, respectively;

a motor within the housing, the motor driving one of the drive gears;

a power source for the motor;

a switch on an exterior of the housing, the switch controlling the power source to the motor;

a blade holder for removably holding the blade, the blade holder having a first end, a second end, and a length therebetween, the blade holder comprising:

a rectangular guide comprising part of the length, the guide slideably fitting within the housing slot;

a handle on the first end of the blade holder;

a blade clamp on the second end of the blade holder, the blade clamp comprised of a flexible material with memory.

14. The apparatus according to claim 13 wherein the hinged fit of the lid to the housing further comprises a female hinge on the lid;

a male hinge on the housing.

15. The apparatus according to claim 14 further comprising a flexible lid, the flexibility sufficient to allow removal of the lid from the housing.

16. The apparatus according to claim 13 wherein the bottom of the housing is further comprised of a plurality of non-slip feet.

17. The apparatus according to claim 14 wherein the bottom of the housing is further comprised of a plurality of non-slip feet.

18. The apparatus according to claim 15 wherein the bottom of the housing is further comprised of a plurality of non-slip feet.

19. The apparatus according to claim 17 wherein the blade holder handle further comprises a non-slip grip.

20. The apparatus according to claim 18 wherein the blade holder handle further comprises a non-slip grip.

* * * * *